United States Patent [19]

Roller et al.

[11] 4,418,272

[45] Nov. 29, 1983

[54] ELECTRIC HEATER

[75] Inventors: Hanno Roller, Kandel; Karl-Heinz Nauerth, Erlenbach, both of Fed. Rep. of Germany

[73] Assignee: Fritz Eichenauer GmbH & Co. KG, Kandel, Fed. Rep. of Germany

[21] Appl. No.: 270,598

[22] Filed: Jun. 4, 1981

[51] Int. Cl.[3] ..... H05B 3/02

[52] U.S. Cl. ..... 219/541; 219/283; 219/505; 219/523; 219/540; 219/544; 219/553; 338/22 R

[58] Field of Search ..... 219/210, 301, 283, 328, 219/504, 505, 508, 520, 530, 523, 534, 535, 537, 540, 541, 539, 544, 552, 553; 174/16 HS, DIG. 5; 338/22 R, 25 SD, 316, 220, 328

[56] References Cited

U.S. PATENT DOCUMENTS

| | | | |
|---|---|---|---|
| 3,940,591 | 2/1976 | Ting | 219/544 |
| 3,996,447 | 12/1976 | Bouffard et al. | 219/541 |
| 4,086,467 | 4/1978 | Grant | 219/544 |
| 4,091,267 | 5/1978 | Grant | 219/544 |
| 4,104,509 | 8/1978 | Bokestal et al. | 219/544 |
| 4,147,927 | 4/1979 | Pirottr | 219/541 |
| 4,151,401 | 4/1979 | Bokestal et al. | 219/508 |
| 4,223,208 | 9/1980 | Kleinschmidt et al. | 219/530 |
| 4,327,282 | 4/1982 | Nauerth | 219/541 |
| 4,331,860 | 5/1982 | Roller et al. | 219/544 |
| 4,334,141 | 6/1982 | Roller et al. | 219/283 |
| 4,371,771 | 2/1983 | Roller et al. | 219/541 X |

*Primary Examiner*—Volodymyr Y. Mayewsky
*Attorney, Agent, or Firm*—Antonelli, Terry & Wands

[57] ABSTRACT

An electric heater, especially for small electric appliances, such as hair roller heaters, egg boilers, or the like, and a method of making same utilizes at least one heating element having contact-making zones on opposite planar parallel surfaces thereof, electrical connection elements in the form of essentially planar contact plates, a contact plate being placed on each of the opposite surfaces, and a holding member having a heat conducting, electrical insulating layer upon a surface thereof. The holding member is bent into a U-shape so as to hold the contact plates clamped fast to the heating elements between legs of the U-shape of the holding member and with the insulating layer disposed on an inner surface of the U-shape between the plates and holding member. In accordance with a preferred embodiment, the insulating layer is of a resilient material having a heat-conductive additive distributed therethrough and the heating elements are formed of PTC material.

13 Claims, 3 Drawing Figures

ELECTRIC HEATER

BACKGROUND AND SUMMARY OF THE INVENTION

The invention relates to an electric heater, expecially for small electric appliances, such as hair roller heaters, egg boilers, or the like, with at least one flat, square heating element with contact-making zones on opposite surfaces, as well as with electrical connection elements in the form of essentially planar contact plates placed on contact-making zones of opposite sides of the heating elements.

In electric warmup or heating appliances, especially small electric devices such as hair roller heaters or the like, it is desirable to provide a satisfactory and uniform heat transfer from the heating elements to the regions to be heated over a relatively large area. Therefore, flat, elongated heaters are utilized. The heating elements employed usually are to an increasingly greater extent so-called PTC elements, i.e. heating elements of PTC material or heat conductors having a positive temperature gradient. Such PTC elements customarily exhibit a prismatic shape with two opposed planar-parallel surfaces and a round or polygonal outline and are contructed, in particular, as square plates. Such PTC elements ordinarily consist of a ceramic material, especially on the basis of barium titanate, and have the property that they are so to speak self-stabilizing with respect to their rate of electric power input, because the electric resistance increases greatly within certain temperature ranges so that the conductivity and the heat transmission of the heating element are constantly self-regulated.

DOS No. 2,845,965 (corresponding to U.S. Pat. No. 4,327,282) discloses such a heater wherein the contact plates, resting on both sides on the resistance heating elements, are held together elastically along the edge zone. This design per se is satisfactory, but cannot be utilized with equally good effects in every case of application, for example in those instances where heat transfer to another body is to be carried out by direct physical contact with the heater. This is so because the clamping members on the edge side necessitate a certain spacing between the heated surface of the heater and a body contacted by the heater, unless the body to be heated up is fashioned in a suitable manner, which is not always possible.

Therefore, an object of the invention is to solve the problem of providing a technically simple and thus inexpensive heater exhibiting flat heat-transfer surfaces which can be placed in a simple and practical way against a body to be heated.

This problem has been solved according to a preferred embodiment of the invention in a heater of the type mentioned in the foregoing by the feature that the heating elements and the contact plates resting on both sides are clamped fast between the legs of a holding member bent into a U-shape and provided on the inside with an insulating layer, this holding member extending over the heating elements and contact plates along their entire widths. By this construction, the heating elements and the contact plates are, first of all, reliably and securely held in place in a simple way. Moreover, the heater of this invention ensures the presence of a flat and completely planar contact surface via which the heat generated by the heating elements can be further transferred uniformly in the entire length of the heater.

The heater of the present invention also exhibits the advantage that the heat output can be extensively selected arbitrarily in a suitable way by inserting and retaining a larger or smaller number of heating elements in the holding member between the contact plates.

The provision is made as a preferred feature that the insulating layer is a heat-conductive, electrically insulating coating of the holding member, the coating being resilient in a certain way so that excessively strong forces during compression of the holding member into its U-shaped form, wherein it holds the contact plates and the heating elements together, are not transmitted to the heating elements. The heat-conductive, electrically insulating coating consists preferably of silicone rubber rendered heat-conductive by appropriate additives, such as, for example, magnesium oxide or the like. This is of advantage, in particular, if the provision is to be made in a further preferred embodiment that the space between the U-legs at the ends of the holding member is sealed by an insulating material and/or that the holding member is sealed off in the area of the ends of the U-legs over its entire length by insulating material. If the entire heater is sealed off at the open sides of the U-shaped holding member, the heater of this invention can also be utilized in a moist or wet environment, which is not readily possible in case of the heater according to DOS No. 2,845,965. The latter would first have to be separately sealed off completely.

A further feature of the preferred embodiment is that provision is made for the contact plates to be equipped with contact reeds [tongues] formed integrally therewith, which reeds are laterally extended from the holding member, the contact reeds being fashioned especially in the form of plug-in elements. In this case, one plug-in element can be constructed as a flat plug and the other as a flat plug socket or receptacle. Preferably, the contact reeds are furthermore provided with insulating sleeves placed thereon in the zone where they are extended out of the U-shaped holding member. These insulating sleeves consist, for example, of shrunk-on film [sheeting] insulating the contact reeds reliably against each other as well as with respect to the U-shaped holding member; this is important if the holding member consists of a conductive material, e.g. aluminum sheet.

These and further objects, features and advantages of the present invention will become obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
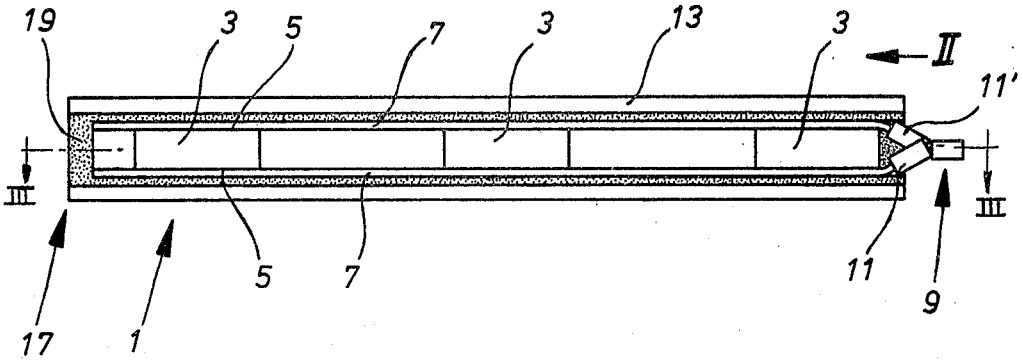
FIG. 1 is a lateral view of an embodiment of the heater according to this invention in the direction of arrow I of FIG. 2, with the seal omitted.
Figure 2:
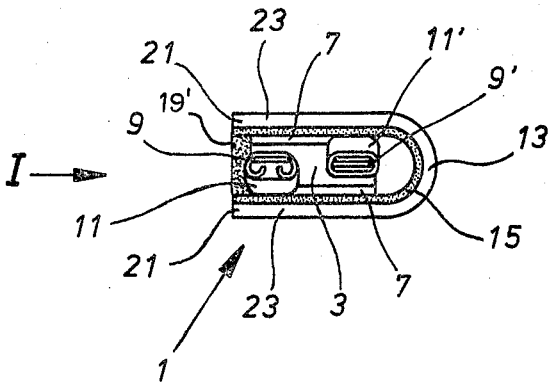
FIG. 2 is an illustration of the same embodiment of the heater according to this invention in the direction of arrow II of FIG. 1.
Figure 3:
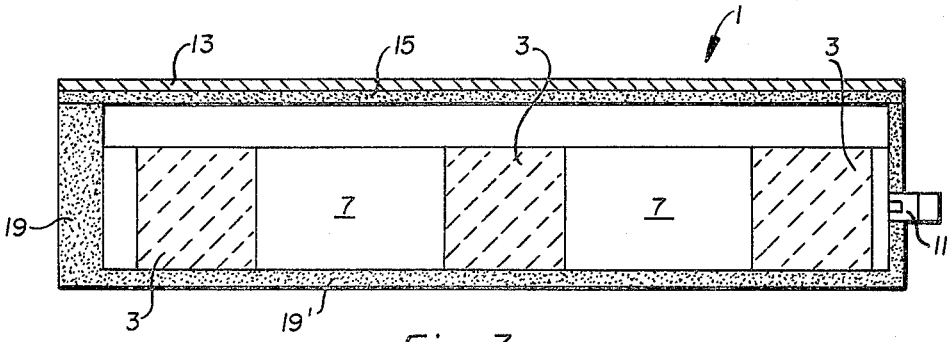
FIG. 3 is a cross-sectional view taken along line III—III of FIG. 1.

The electric heater 1 illustrated in the drawing consists in its basic structure of several series-disposed heating elements 3 of heat-conductive material having a positive temperature coefficient, or, in short, PTC material. The heating elements 3 have the shape of flat, square plates (but may be round, rectangular, or other polygonal shapes) their oppositely disposed, planar-parallel contact surfaces 5 being provided, in a manner that is conventional per se, with a metallic contacting (not shown in detail). The resistance elements are arranged in sandwich style between contact plates 7, which latter correspond at least in their width to the width of an individual resistance heating element 3. The two contact plates 7 consist of aluminum sheet material and are equipped with respectively one contact reed 9,9' fashioned as plug elements, wherein the contact reed 9 is constructed as a flat plug socket and the contact reed 9' is designed as a flat plug. This creates a simple means for connecting a cable. Respectively, one insulating sleeve 11, 11' is placed on the plug elements 9, 9', this sleeve consisting, for example, of shrunk-on film or the like.

The arrangement described thus far has no inherent cohesion but rather must be held together by a holding member 13. The holding member 13 consists of an aluminum sheet material which is provided on its inner surface with an electrically insulating, but heat-conductive coating 15. The coating 15 consists, for example, of silicone rubber with appropriate heat-conductive additives, such as magnesium oxide or the like. The holding member 13 with coating 15 is then bent in a U-shape around the above-described arrangement of resistance elements 3 and contact plates 7 and is compressed in such a way that it securely retains the contact plates 7 and especially the heating elements 3. Excessive stress peaks during compression are absorbed, if necessary, by the resilient coating 15, although the heater of this invention is nowise impaired in efficiency if the individual PTC heating elements rupture, as long as the individual fragments are reliably held by the holding member 13.

The U-shaped profile is sealed off at one end 17 by a plug 19 of the same material as the coating substance 15. A corresponding closure may also be provided on the opposite end of the holding member 13 where the connection contacts are extended. Finally, a corresponding seal 19' could also be arranged between the free ends 21 of the U-shape 23 of the holding member 13 over the entire length thereof. A reliable sealing encapsulation of the heater of this invention is created by such a complete enclosure.

In total, the invention creates a rugged, reliable heater with an extensively selectable heating output, by being able to insert, depending on requirements, a larger or smaller number of individual heating elements 5 in a heater of a predetermined length and to distribute these heating elements over the length thereof in a suitable way. In the illustrated embodiment of FIG. 1, three heating elements 5 are provided. In the embodiment shown, approximately six heating elements of the illustrated dimensions can be inserted in total.

While I have shown and described a single embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

We claim:

1. Electric heater, especially for small electric appliances, such as hair roller heaters, egg boilers, or the lke, comprising:

at least one flat, heating element having contact-making zones on opposite planar parallel surfaces thereof;

electrical connection elements in the form of essentially planar contact plates, a contact plate being placed on each of said opposite surfaces;

and a holding member formed of a flat sheet of material which has been bent into a U-shape having legs which are mutually spaced in a manner so as to hold the contact plates clamped fast to said at least one heating element between the legs of said U-shape of the holding member by the direct action of a clamping pressure exerted thereby, said holding member extending over the entire width of the at least one heating element and the contact plates having a heat conducting electrical insulating layer upon an inner surface of said U-shape between said plates and holding member.

2. Heater according to claim 1, characterized in that the insulating layer is a heat-conductive, electrically insulating coating of the holding member.

3. Heater according to claim 1 or 2, characterized in that a space between the legs of the U-shape is sealed off by an insulating material at lateral ends of the holding member.

4. Heater according to claim 1 or 2, wherein said at least one heating element is square.

5. Heater according to claim 1, wherein several heating elements are provided between the contact plates.

6. Heater according to claim 1, wherein said insulating layer is a resilient material with a heat-conductive additive distributed therethrough.

7. Heater according to claim 3 characterized in that the holding member is sealed-off by insulating material in the region of free ends of the legs of the U-shaped over the entire length thereof.

8. Heater according to claim 3, wherein said at least one heating element is square.

9. Heater according to claim 1, characterized in that each of the contact plates is provided with a contact reed integrally formed therewith, said contact reeds being extending laterally out of the holding member.

10. Heater according to claim 9, characterized in that an insulating sleeve is placed onto each contact reed over part of the length thereof.

11. Heater according to claim 9 or 10, characterized in that the contact reeds are fashioned as plug-in elements.

12. Heater according to claim 11, wherein the plug-in element of one contact reed is a flat plug and the plug-in element of the other contact reed is a flat plug socket.

13. Heater according to claim 1 or 2 or 6, wherein said heating elements are formed of PTC material.

* * * * *